US008930066B2

(12) United States Patent
McKee et al.

(10) Patent No.: US 8,930,066 B2
(45) Date of Patent: Jan. 6, 2015

(54) CUSTOMIZABLE CONTROL APPARATUS AND METHOD FOR A VEHICLE TURRET

(75) Inventors: Michael A. McKee, Aurora, IL (US); John E. Hayden, Aurora, IL (US)

(73) Assignee: Control Solutions LLC, Aurora, IL (US)

( * ) Notice: Subject to any disclaimer, the term of this patent is extended or adjusted under 35 U.S.C. 154(b) by 525 days.

(21) Appl. No.: 13/187,928

(22) Filed: Jul. 21, 2011

(65) Prior Publication Data

US 2012/0191292 A1 Jul. 26, 2012

Related U.S. Application Data

(60) Provisional application No. 61/435,037, filed on Jan. 21, 2011.

(51) Int. Cl.
*G01M 17/00* (2006.01)

(52) U.S. Cl.
USPC ..... 701/33.2; 701/33.4; 701/48; 89/36.13; 89/40.03; 89/918; 89/41.02; 700/86; 700/83

(58) Field of Classification Search
USPC ..... 701/33, 49, 33.2, 33.4; 89/36.13, 41, 89/41.02, 935, 36.07, 36.08, 40.03, 918; 700/83, 86
See application file for complete search history.

(56) References Cited

U.S. PATENT DOCUMENTS 4,004,494 A * 1/1977 Mechulam et al. ..... 89/36.14
4,574,685 A * 3/1986 Sanborn et al. ..... 89/37.14
5,220,127 A * 6/1993 Tiomkin et al. ..... 89/36.14
5,625,159 A 4/1997 Malolepsy et al.
5,880,395 A 3/1999 Krumm et al.
6,101,917 A 8/2000 Klatte et al.
6,596,976 B2 * 7/2003 Lin et al. ..... 244/3.2
6,701,821 B2 3/2004 Lundqvist et al.
7,021,189 B2 * 4/2006 Patry et al. ..... 89/45
7,274,976 B2 * 9/2007 Rowe et al. ..... 701/1
7,451,028 B2 * 11/2008 Pillar et al. ..... 701/50
7,715,962 B2 * 5/2010 Rowe et al. ..... 701/36
8,428,827 B2 * 4/2013 McKee et al. ..... 701/48
8,607,686 B2 * 12/2013 McKee et al. ..... 89/41.02
2007/0061054 A1 * 3/2007 Rowe et al. ..... 701/1
2007/0230451 A1 * 10/2007 Porat et al. ..... 370/357
2008/0215190 A1 * 9/2008 Pillar et al. ..... 701/1
2008/0221754 A1 * 9/2008 Rowe et al. ..... 701/36
2012/0191292 A1 * 7/2012 McKee et al. ..... 701/33.1

OTHER PUBLICATIONS

A study of a gun-turret assembly in an armored tank using model predictive control; Kumar, G. ; Tiwari, P.Y. ; Marcopoli, V. ; Kothare, M.V.; American Control Conference, 2009. ACC '09.; Digital Object Identifier: 10.1109/ACC.2009.5160524. Publication Year: 2009 , pp. 4848-4853.*

(Continued)

*Primary Examiner* — Cuong H Nguyen
(74) *Attorney, Agent, or Firm* — McCracken & Gillen LLC

(57) ABSTRACT

A customizable apparatus for controlling rotational movement of a turret of a vehicle is provided. The apparatus includes a memory that stores information relating to operation of the turret. A communication port of the apparatus is adapted to exchange communications relating to operation of the turret with an external computing device. A controller processes communications received at the communication port from the external computing device. The controller processes the communications, and the controller selectively provides access to the stored information relating to operation of the turret to the external computing device.

30 Claims, 4 Drawing Sheets

(56) References Cited

OTHER PUBLICATIONS

Application of Radio Frequency Controlled Intelligent Military Robot in Defense; Naskar, S. ; Das, S. ; Seth, A.K. ; Nath; A. Communication Systems and Network Technologies (CSNT), 2011 International Conference on; Digital Object Identifier: 10.1109/CSNT.2011.88; Publication Year: 2011 , pp. 396-401.*

Enhanced Armored Vehicle Fire Control System Design Modifications; Perkins, Toney R. ; Groff, John N. American Control Conference, 1986; Publication Year: 1986 ,pp. 841-846.*

Evaluating the benefits of augmented reality for task localization in maintenance of an armored personnel carrier turret Henderson, S.J. ; Feiner, S.;Mixed and Augmented Reality, 2009. ISMAR 2009. 8th IEEE International Symposium on Digital Object Identifier: 10.1109/ISMAR.2009.5336486; Publication Year: 2009 , pp.:135-144.*

Variable structure control of a tank gun; Dana, R. ; Kreindler, E.; Control Applications, 1992., First IEEE Conference on DOI: 10.1109/CCA.1992.269797; Publication Year: 1992 , pp. 928-933 vol. 2.*

A study of a gun-turret assembly in an armored tank using model predictive control; Kumar, G. ; Tiwari, P.Y. ; Marcopoli, V. ; Kothare, M.V.; American Control Conference, 2009. ACC '09; DOI: 10.1109/ACC.2009.5160524 Publication Year: 2009 , pp. 4848-4853.*

Surrogate teleoperated vehicle (STV); Myers, S.D.; Aerospace and Electronic Systems Magazine, IEEE; vol. 6 , Issue: 7 DOI: 10.1109/62.89000; Publication Year: 1991 , pp. 3-9.*

Robust Digital Control of Gun Turret Systems; Chai, W. ; Loh, N.K. ; Lin, C.F. ; Coleman, N.; American Control Conference, 1992; Publication Year: 1992 , pp. 419-423.*

Hybrid Optimal Control of Turret-Gun System; Zhang, J.L. ; Shieh, L.S.; American Control Conference, 1993 Publication Year: 1993 , pp. 541-546.*

* cited by examiner

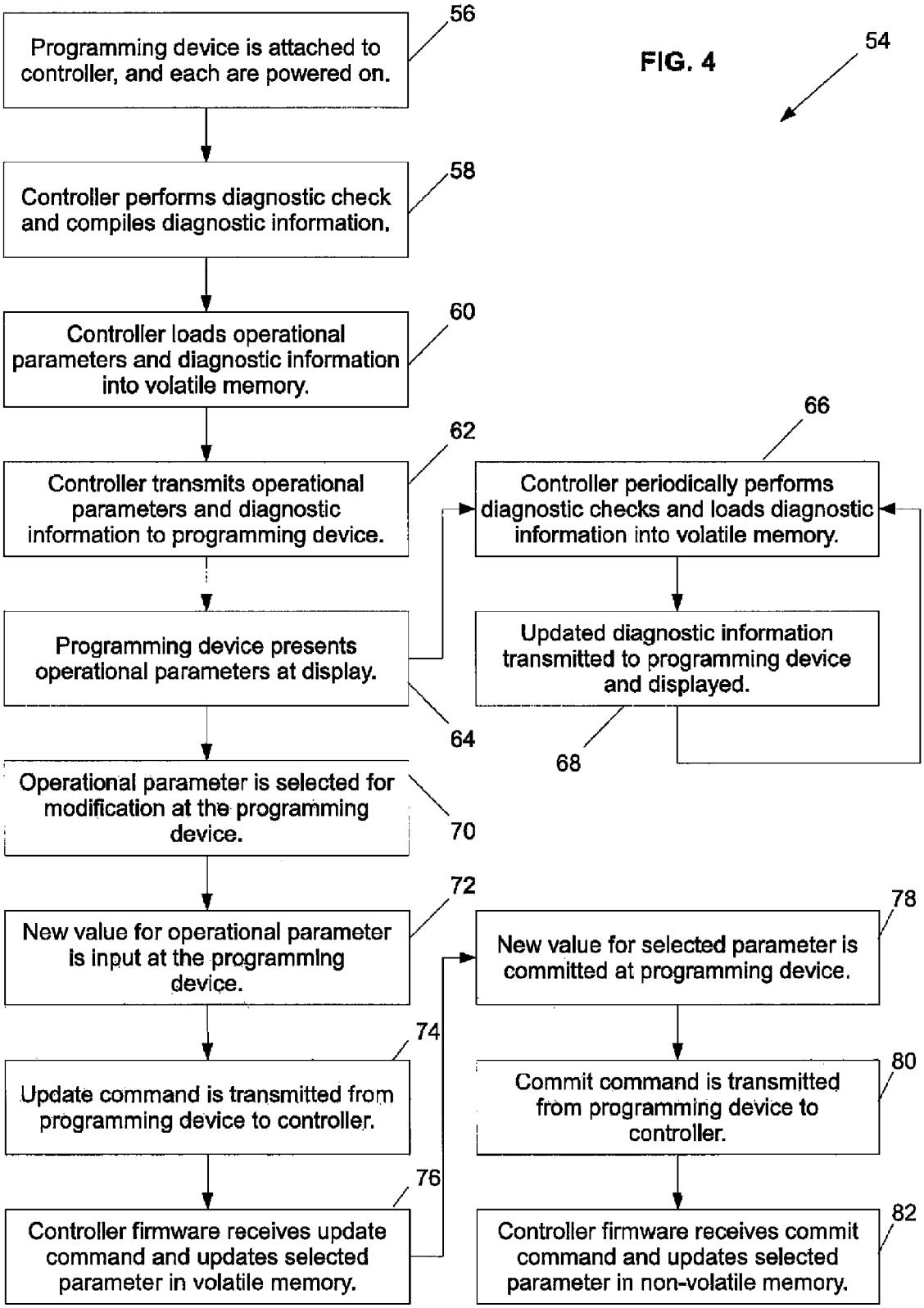
FIG. 4
54
56
Programming device is attached to controller, and each are powered on.
58
Controller performs diagnostic check and compiles diagnostic information.
60
Controller loads operational parameters and diagnostic information into volatile memory.
62
Controller transmits operational parameters and diagnostic information to programming device.
66
Controller periodically performs diagnostic checks and loads diagnostic information into volatile memory.
Programming device presents operational parameters at display.
Updated diagnostic information transmitted to programming device and displayed.
64
68
Operational parameter is selected for modification at the programming device.
70
72
New value for operational parameter is input at the programming device.
78
New value for selected parameter is committed at programming device.
74
Update command is transmitted from programming device to controller.
80
Commit command is transmitted from programming device to controller.
76
Controller firmware receives update command and updates selected parameter in volatile memory.
82
Controller firmware receives commit command and updates selected parameter in non-volatile memory.

CUSTOMIZABLE CONTROL APPARATUS AND METHOD FOR A VEHICLE TURRET

CROSS-REFERENCE TO RELATED APPLICATION

The present application claims the priority benefit of U.S. Provisional Patent Application Ser. No. 61/435,037 filed Jan. 21, 2011 and entitled "Customizable Control Apparatus and Method for a Vehicle Turret," the disclosure of which is incorporated herein by reference.

FIELD OF THE INVENTION

This invention relates to controllers for vehicle turrets and, in particular, relates to controllers for vehicle turrets having mutable operational parameters.

BACKGROUND

Armored vehicles may include a rotatable turret and a weapon mounted to the turret for use in military operations. To assist the turret operator in rotating the turret, a controlled drive system may be installed in the armored vehicle. The drive system may include a motor that drives rotation of the turret and a controller that provides instructions to the motor. For example, the controller may instruct the motor to rotate the turret clockwise or counterclockwise depending on input from the turret operator.

Controllers for vehicle turrets may control various aspects of turret rotation, e.g., rotational speed. However, many of these aspects of turret rotation are fixed at the controller upon manufacture, and modification in the field may prove to be difficult. Individual turret operators may have different preferences regarding turret rotation. Additionally, the particular circumstances of military operations may necessitate vehicle turrets having different rotational characteristics. Thus, there exists a need for controllers of vehicle turrets where the aspects of turret rotation may be modified and customized in the field.

Further, in some circumstances, diagnosing performance issues with known controllers of vehicle turrets and turret drive systems may proceed in a trial-and-error fashion. Service personnel may inspect and test individual components of the controlled turret drive system to isolate a problem. Such an approach is costly and time consuming. Thus, there also exists a need for a controller of a vehicle turret that allows service personnel to quickly and easily identify performance issues of controlled turret drive systems.

SUMMARY

A customizable apparatus for controlling rotational movement of a turret of a vehicle is provided. The apparatus includes a memory that stores information relating to operation of the turret. A communication port of the apparatus is adapted to exchange communications relating to operation of the turret with an external computing device. A controller processes communications received at the communication port from the external computing device. The controller processes the communications, and the controller selectively provides access to the stored information relating to operation of the turret to the external computing device.

A method for customizing controlled rotational movement of a turret of a vehicle is also provided. Information relating to operation of the turret is stored in a memory. A controller exchanges communications relating to operation of the turret with an external computing device. The communications received from the external computing device are processed to selectively provide access by the external computing device to the stored information relating to operation of the turret.

BRIEF DESCRIPTION OF THE DRAWINGS

FIG. 4 is a flowchart of example method steps for modifying an operational parameter and viewing diagnostic information at a vehicle turret controller.

DETAILED DESCRIPTION

Figure 1:
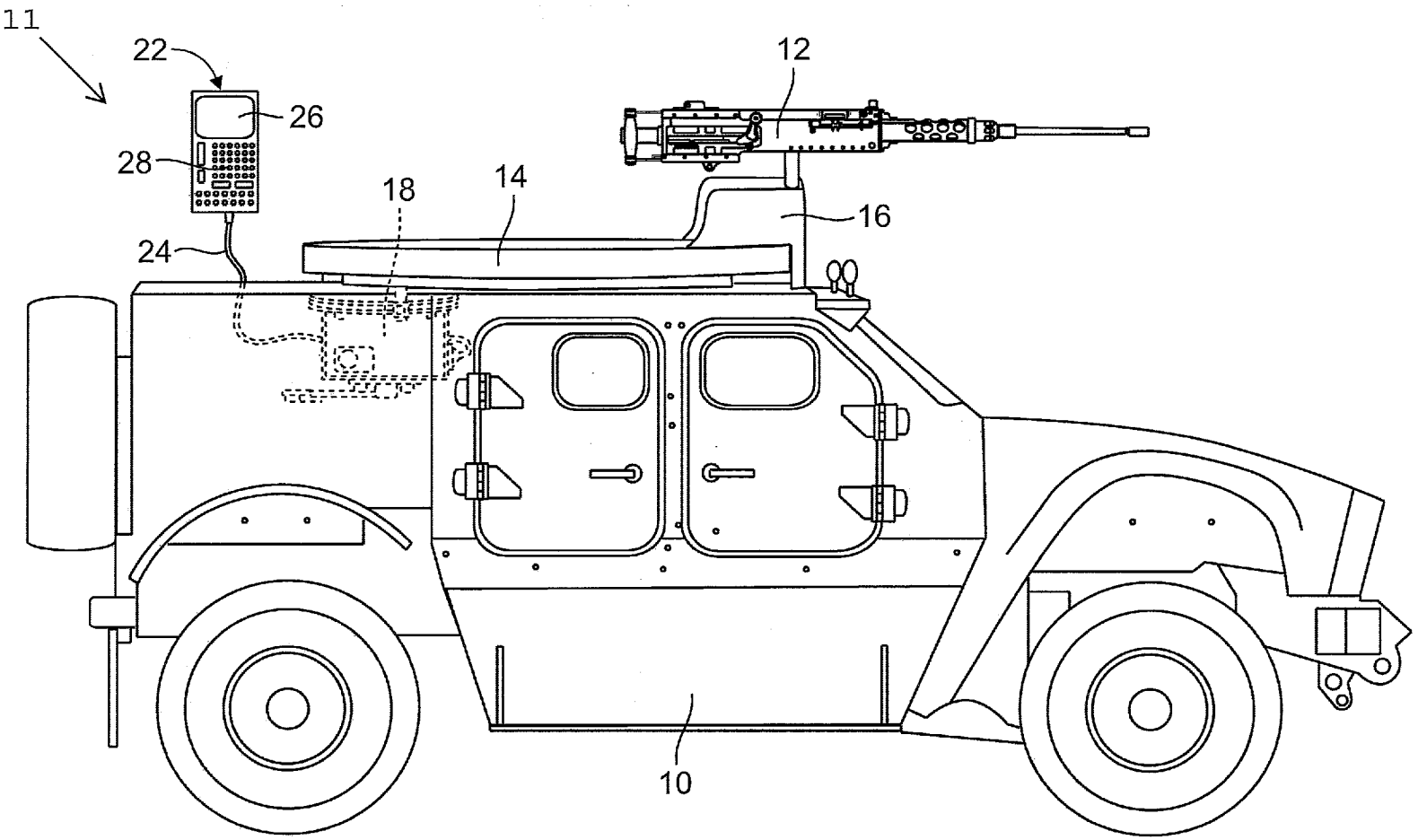
FIG. 1 is a right side view of an armored vehicle having a rotatable turret and a turret controller with a hand-held programming device attached to the controller.

A customizable apparatus 11 for controlling rotational movement of a turret of a vehicle is provided. Referring to FIG. 1, a right profile view of an armored vehicle 10 having a firing device 12 mounted to a rotatable turret 14 is shown. The turret 14 may fully rotate 360° in a clockwise or counterclockwise direction. The turret 14 may include, among other components, shielding 16 to protect an operator during operation of firing device 12. In the example shown, the firing device 12 is a .50-caliber heavy machine gun (United States military designation Browning Machine Gun, Cal .50, M2, HB, Flexible) with a butterfly-style trigger.

As shown in FIG. 1, a controller 18 may be situated beneath the rotatable turret 14 that controls rotation of the turret in a clockwise (CW) or counterclockwise (CCW) direction. The controller 18 is coupled to a motor 20 (FIG. 2) and transmits instructions to the motor for rotating the turret 14. Information relating to the operation of the turret 14 is stored at the controller 18. Information relating to operation of the turret 14 includes various operational parameters stored at the controller 18 that may determine aspects of turret rotation. For example, the controller 18 may instruct the motor 20 to drive rotation of the turret 14 at a predetermined speed. The predetermined speed of turret rotation may be stored at the controller 18 as a value indicating the maximum rotations-per-minute (RPM). Other parameters related to turret rotation are discussed in further detail below. Information relating to operation of the turret 14 stored at the controller 18 also includes various diagnostic information relating to current and past operation of the turret 14.

FIG. 1 also shows an external computing device 22 in signal communication with the controller 18 for the turret 14 of the vehicle 10. In this example, the computing device 22 is coupled to the controller 18 via an electrical cable 24. The computing device 22 may additionally or alternatively communicate with the controller 18 via a wireless communication interface. The computing device 22 may be provided access to the information stored at the controller 18 at the selection of a user. For example, the computing device 22 may be used to input information to modify or update the various operational parameters relating to turret rotation stored at the controller 18. Further, the computing device 22 may be used to retrieve diagnostic information relating to turret rotation stored at the controller 18. The computing device may be, for example, a hand-held programming device, a desktop computer, a laptop computer, a tablet computer, mobile telephone, personal digital assistant (PDA) and the like. The computing device 22, in the example shown, is a hand-held programming device.

The hand-held programming device 18, in this example, includes components typical of a computing device such as, for example, a display 26 for displaying information to an operator; input elements 28 for receiving instructional user input from the operator; a processor (not shown) for executing the functions associated with the programming device; a memory (not shown); and an input/output module (not shown) for exchanging communications relating to the user input with the controller 18. The display 26 of the programming device may include any device operable to convert electrical signals into information presented to the user in some visually perceivable form, such as, for example, a liquid crystal display (LCD), a cathode-ray tube (CRT) display, an electroluminescent display (ELD), a heads-up display (HUD), a plasma display panel (PDP), or a vacuum fluorescent display (VFD).

The input elements 28 may include, for example, buttons for entering, editing, and browsing information presented at the display 26 of the programming device 22 as well as for entering instructional user input to update or retrieve the information relating to operation of the turret 14 stored at the controller. The processor of the programming device 22 may be any form of microprocessor capable of executing instructions or code. The memory of the programming device 22 may be any form of data storage mechanism accessible by the programming device or any combination of such forms, such as, a magnetic media, an optical disk, a random access memory (RAM), a flash memory, or an electrically erasable programmable read-only memory (EEPROM). A suitable programming device 22 may be available from Control Solutions LLC of Aurora, Ill. as model designation CS1171.

Figure 2:
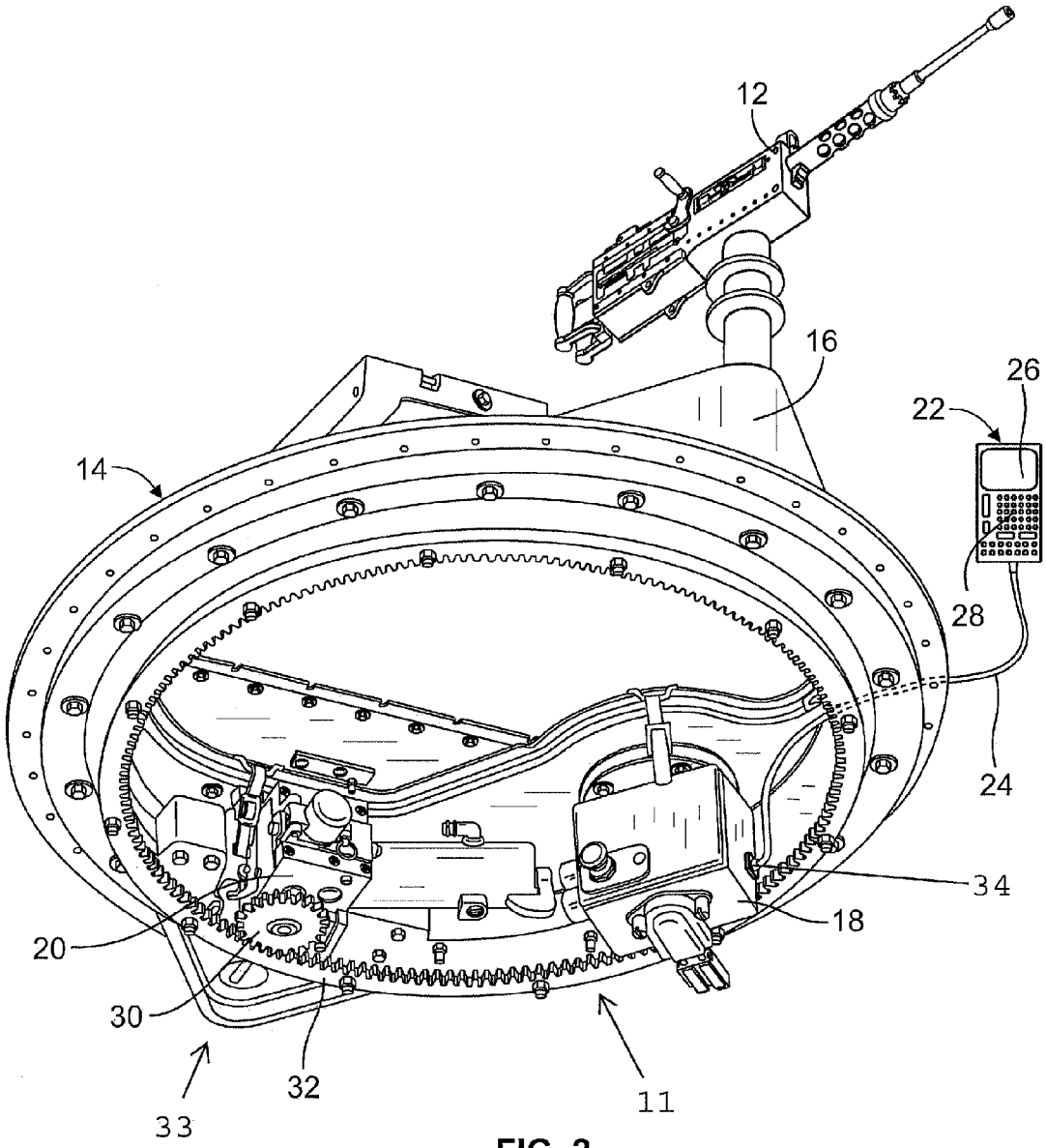
FIG. 2 is a bottom right perspective view of a turret and a controlled turret drive system for an armored vehicle with a hand-held programming device coupled with the controller.

Referring now to FIG. 2, a bottom right perspective view of the vehicle turret 14 and apparatus 11 for controlling rotational movement of the turret is shown. As mentioned above, a controller 18 may be situated beneath the turret 14 for controlling rotation of the turret based on input from an operator. The controller 18 is coupled to a motor 20, which is used to drive the rotation of the turret 14. The motor 20 includes a drive gear 30 that meshes with a ring gear 32 mounted to the turret 14. Accordingly, as the motor 20 spins the drive gear 30, the drive gear transmits the torque to the ring gear 32, which causes the turret 14 to rotate in a CW or CCW direction. The motor 30, drive gear 32, and ring gear 34 may be collectively referred to as a turret drive system 33. As seen in FIG. 2, a programming device 22 is coupled to the controller 18 at a communication port 34. The communication port 34 is adapted to exchange communications between the controller 18 and the programming device 22. The communication port 34 may be any wired or wireless communication interface that provides for communication between the controller 18 and the computing device 22. For example, the communication port 34 may be a Universal Serial Bus (USB) port, Ethernet port, or controller area network (CAN) bus for wired communications or a wireless transceiver for wireless communications. The programming device 22 enables an operator to modify operational parameters and diagnostic information relating to turret rotation stored at the controller 18.

Figure 3:
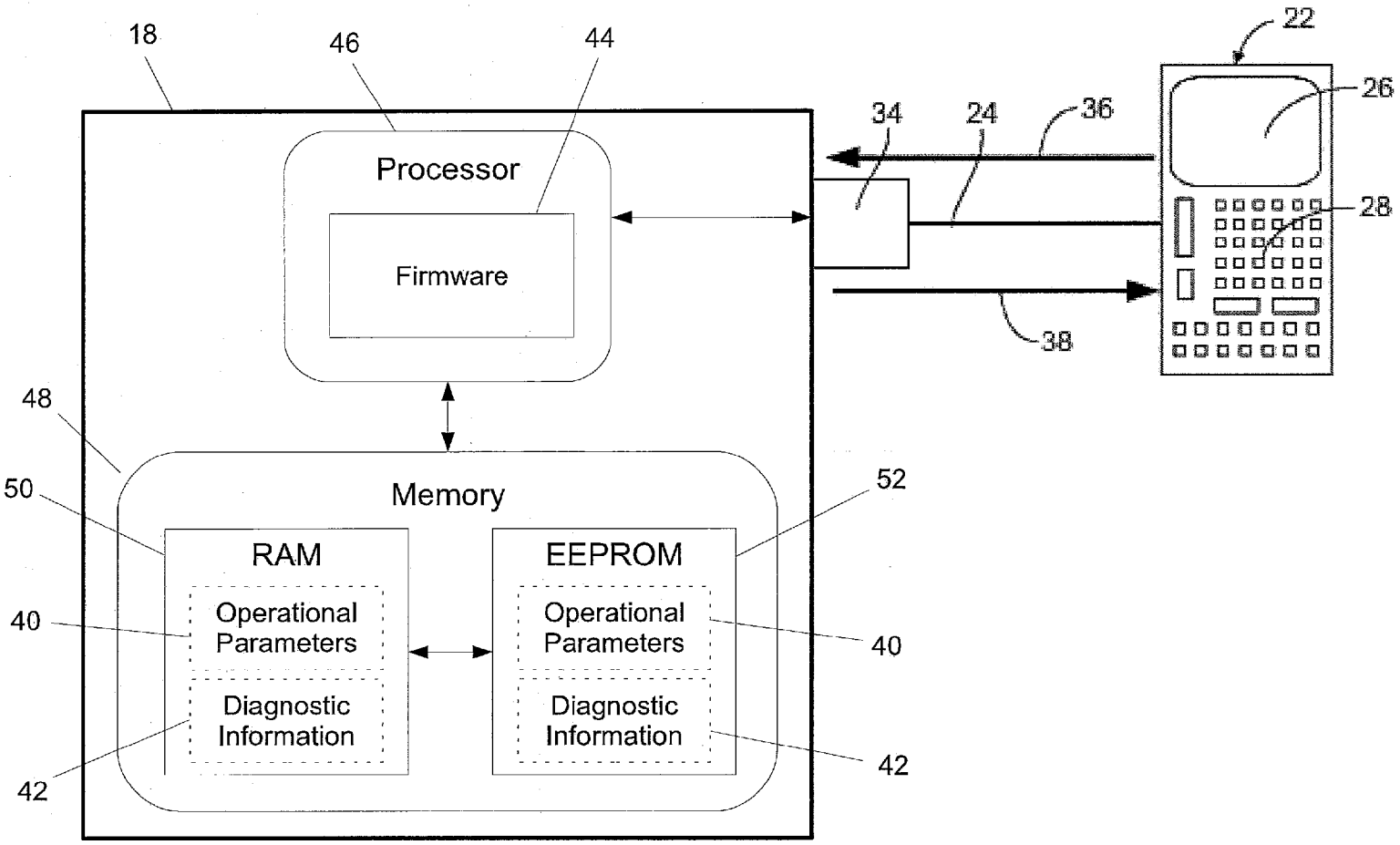
FIG. 3 is a schematic view of a vehicle turret controller and a programming device coupled with the controller.

Turning to FIG. 3, a schematic view of a programming device 22 attached to a controller 18 for a vehicle turret is shown. The controller 18 includes an external communication port 34, in this example an electrical port, for coupling the controller to the programming device 22 via a cable 24. In this example, the electrical communication port 34 is an electrical port as discussed above and serves as a data port between the programming device 22 and the controller 18. An electrical cable 24 couples the programming device 22 to the controller 18 as shown by way of example in FIG. 3. The electrical cable 24 may be, for example, a 4-pin or 8-pin electrical cable having a circular bayonet-type connector. Additional or alternative types of wired or wireless couplings between the communication port 34 of the controller 18 and the programming device 22 may be selectively employed. For example, a transmitter/receiver arrangement may be employed for wireless communication between the programming device 22 and a wireless communication port 34 in an alternative configuration.

As seen in FIG. 3, various communications 36, 38 are exchanged between the programming device 22 and the controller 18 via the data port 34. For example, the programming device 22 may transmit a communication 36 that includes an instruction to update a selected operational parameter 40 stored at the controller 18 and a new value for the parameter. Alternatively, the programming device 22 may transmit a communication 36 that includes an instruction to transmit to the programming device 22 selected diagnostic information 42 stored at the controller. In response, the controller may retrieve the selected diagnostic information 42 and transmit a communication 38 that includes the requested diagnostic information 42 to the programming device 22 where it may be presented at the display 26 to the operator.

The controller 18 for a vehicle turret may include various hardware components used to store, modify, and retrieve the operational parameters 40 and/or operational diagnostic information 42. As seen in FIG. 3, the controller 18 for the vehicle turret includes firmware 44, a processor 46, and a memory 48. The firmware 44 may be a combination of hardware, data, and computer instructions that reside as read-only software at the processor 46. The firmware 44 monitors the data port 34 of the controller 18 for signals 36 received from the programming device 22. The firmware 44 and the processor 46, in the example shown, process the signals 36 received at the data port 34. The firmware 44 and the processor 46 also forward diagnostic information 42 to the data port for transmission to the programming device 22.

The firmware 44 and the processor 46 process communications 36, 38 received at the communication port 34 from the programming device such as, for example, updating or retrieving information relating to operation of the turret. Like the processor of the programming device 22, the processor 46 of the controller 18 may be any form of microprocessor capable of executing instructions or code. The memory 48 of the controller 18 includes both volatile RAM 50 and non-volatile EEPROM 52. As seen in FIG. 3, the operational parameters 40 and the diagnostic information 42 may be stored at the RAM 50 and the EEPROM 52 of the example controller 18.

The computing device 22 is configured to read the values stored in the volatile memory 50 and non-volatile memory 52 of the controller 18. The computing device 22 may access data stored in the memory 48 of the controller 18 by specifying the memory address where the desired data is located (e.g., memory position 3A). Operational parameters 40 may be stored in the non-volatile memory 52 for persistent storage and loaded into the volatile memory 50 during power-up of the controller 18. With a computing device 22 in signal communication with the controller 18 an operator may review and update the operational parameters relating to turret control during, for example, testing and maintenance of the turret control system.

Until the operator commits the update to the operational parameter, changes to operational parameters may be reflected in the volatile memory 50 of the controller, but not the non-volatile memory 52. When the operator confirms the update to the operational parameter, the change to the parameter may be committed to the non-volatile memory 52 of the controller 18. Accordingly, an operator may advantageously adjust the turret operational parameters for testing and maintenance purposes; and those adjustments will be reflected in the volatile memory 50 of the controller until the operator commits a change to the non-volatile memory 52 by confirming the update at the computing device 22.

The controller 18 may perform diagnostic checks to compile the diagnostic information 42. The controller 18 may compile some diagnostic information 42 during power-up and store the diagnostic information in the memory 48 of the controller. The controller 18 may compile and store other diagnostic information 42 continually while the turret control system is powered on. In this example, the controller 18 stores diagnostic information 42 in the volatile memory 50 for relatively quick retrieval during transmission of diagnostic information to the computing device 22. The controller 18 in this example may also, however, store certain diagnostic information 42 in the non-volatile memory for persistent storage and load this diagnostic information into volatile memory as needed.

The controller 18 may store the operational parameters 40 and diagnostic information 42 as digital values in the memory 48. Further, the controller 18 may transmit the operational parameters 40 and diagnostic information 42 to the computing device 22 as digital data bytes. The computing device 22 may translate the digital data bytes into decimal values for presentation to an operator on the display 26 of the computing device 22.

As mentioned above, the computing device 22 includes a display for presenting the operational parameters and diagnostic information to an operator. The computing device 22 includes its own local memory (not shown) for storing the operational parameters and diagnostic information received from the controller 18. Additionally, as the controller 18 compiles updated diagnostic information while the turret control system is powered on, the controller 18 may periodically transmit the updated diagnostic information to the computing device 22 to update the presentation of information at the display 26.

The computing device 22 may display the operational parameters and diagnostic information in various ways. For example, if the computing device 22 is a hand-held programming device as shown in FIG. 3, the display 26 may list the operational parameters and diagnostic information in scrollable lists accessible through corresponding menus. Alternatively, if the computing device 22 is a desktop, laptop, or tablet computer, the display may present the operational parameters and diagnostic information simultaneously in a single display screen.

Operational parameters relate to various aspects of controlled turret rotation may relate to how the turret control system drives rotation of the turret in response to input from the turret operator. For example, operational parameters relating to controlled turret rotation may include, but are not limited to, turret rotation settings; throttle settings; and manual override settings.

Turret rotation settings may include, but are not limited to, turret rotation speed, turret acceleration and deceleration, dampening, motor compensation, and motor current limit. Turret rotation speed may depend on, among other things, the system voltage of the turret control system. Accordingly, turret rotation speed may be defined by the percentage of system voltage used to rotate the turret at a particular speed. For example, maximum rotation speed may correspond to 100% of the system voltage, and the operational parameters for turret rotation speed may be stored as a percentage of the system voltage (e.g., 50% of system voltage). A controller 18 may store individual operational parameters for turret rotation speed in both the clockwise (CS) and counterclockwise (CCW) directions. Further, the controller 18 may optionally store an operational parameter relating to the maximum allowed system voltage, which may be set by an operator. For example, a turret control system may have an absolute maximum voltage of 24V, and an operator may set the operational parameter for the maximum allowed system voltage to 18V. As such, the operational parameters for rotational speed, in this example, may be a percentage of the maximum allowed system voltage or, alternatively, as a percentage of the maximum absolute system voltage.

Additional examples of operational parameters relating to turret rotation include operational parameters corresponding to acceleration and deceleration settings for the turret. The acceleration and deceleration settings control how quickly the turret accelerates or decelerates in response to operator input. The controller 18 may respectively store maximum and minimum acceleration and deceleration speeds that collectively define a range of acceleration and deceleration speeds. The controller 18 may also store operational parameters that indicate a desired acceleration and deceleration speed, the values for which respectively fall within the acceleration and deceleration ranges. The values for the acceleration and deceleration speeds may be stored as percentages of the acceleration and deceleration ranges respectively.

Another example of an operational parameter relating to turret rotation includes a dampening ratio. The dampening ratio parameter may be adjusted to control dampening effects provided by the turret control apparatus 11 in order to achieve appropriate turret rotation. Appropriate rotation of the turret may depend on, for example, a turret operator's preferences and the circumstances and environment in which the turret control apparatus 11 will be used to rotate the turret. For example, if the dampening ratio is set too high, then, in some circumstances, the turret may respond to operator input too slowly. If the dampening ratio is set too low, then, in some circumstances, the turret may undesirably oscillate as it rotates. The controller 18 may store the dampening ratio parameter as a numerical value.

Motor compensation and motor current limit are more examples of operational parameters relating to turret rotation. The motor compensation parameter may also be adjusted to maintain a desired rotation speed over varying turret weights. In particular, the controller 18 may use the motor compensation parameter to vary the motor output force in order to maintain a constant rotation speed for variable turret loads. Motor compensation, in this example, may be stored as two numbers: a motor compensation gain value and motor compensation response value. The motor compensation response value represents a response time and filter setting.

Motor current limits protect the motor 20 from potential damage by limiting the amount of current that passes through the motor. Too much motor current can potentially damage the motor 20 or the gearings 30, 32 of the drive system. Too little current, however, can potentially result in operational failures in worst-case scenarios, e.g., where maximum speed is desired when the vehicle is at a maximum off-center of gravity and at a maximum incline. The turret drive system 33 may use different amounts of motor current in different circumstances. For example, the turret drive system 33 may use relatively more motor current, i.e., "peak current," to overcome static forces and initiate rotation of the turret 14 as well as to push past "rough spots" during turret rotation. In order to keep the turret 14 moving, however, the turret drive system 33 may use relatively less motor current, i.e., "average current." Accordingly, because too much peak current for too long can potentially damage the turret drive system 33, motor current limit parameters may be set such that the controller 18 instructs the turret drive system to apply peak current in order to initiate turret rotation or push past rough spots and subsequently step down the amount of motor current to protect the turret drive system.

Throttle settings are another set of operational parameters an operator may modify using the computing device 22. Throttle for the turret drive system 33 is transmitted as a voltage signal that is proportional to the displacement of a throttle control (not shown). Operational parameters relating to throttle settings include throttle gain—the amount of throttle displacement needed to start turret rotation; throttle fail—the amount of displacement that results in cessation of turret rotation; and a fail band used to detect if the throttle has failed due to, for example, a shorted wire or water damage. In some circumstances, the turret control apparatus 11 may include dual throttles an operator may use to rotate the turret 14. Accordingly, operational parameters may be set to indicate which throttle takes priority if an operator activates both throttles simultaneously.

Parameters relating to manual override settings include, but are not limited to, manual override push speeds. Manual override push speeds limit the speed of turret rotation when an operator manually rotates the turret 14 using, for example, a hand-crank (not shown) attached to the motor 20. The turret drive system 33 may include an electromagnetic (EM) brake to prevent the turret 14 from freely rotating back and forth. During a manual override mode, an operator may release the EM brake to rotate the turret 14 manually using a hand-crank. It may be desired, however, to also prevent the turret 14 from freely rotating in manual override mode—for example, when the vehicle is on an incline. Accordingly, a parameter to limit the manual override push speed may be set that limits the maximum speed a turret operator can manually rotate the turret 14. In this example, the controller 18 may provide a braking signal to the turret drive system 33 that makes it relatively more difficult to manually rotate the turret 14 when the rotation speed approaches the manual push speed limit. The parameter for the manual override push speed may, for example, prevent a turret operator from manually rotating the turret 14 faster than the automated drive speed. As a turret operator manually rotates the turret 14, an electrical signal is generated corresponding to the speed of the manually rotated turret. Accordingly, the controller 18, may compare this signal to the manual override push speed to determine when to apply the braking signal and prevent an increase in the manual rotation speed. Manual override push speed may be stored, in this example, as a percentage of the full speed of the turret.

It will be understood that the particular values for the operational parameters may depend on a variety of factors including, but not limited to, the preferences of individual turret operators, the amount of shielding and other equipment attached to the turret that contribute to the turret's weight, the environment in which an operator will operate the turret, and the circumstances of the missions for which the turret will be used. Accordingly, it, will also be understood that values for the operational parameters may be determined following a preselected amount of testing.

Example diagnostic information 42 includes various diagnostic metrics relating to various aspects of controlled turret rotation. As discussed above, the controller 18 may perform a diagnostic check at power-up and at periodic intervals while the controller is powered on to periodically update the diagnostic information. Example diagnostic metrics may include, but are not limited to: battery voltage; temperature of the controller; throttle voltage; motor current; and various error codes. Error codes include and may indicate, for example, a throttle failure; a shorted EM brake; a released EM brake; a shorted motor, an open motor, or an internal failure at the controller 18. Error codes may be stored in the memory 48 of the controller as switch values, and a lookup table in the computing device 22 may associate a text description with each error code for display to an operator. Error codes may help an operator to identify problems at the controller 18 or drive system during maintenance and troubleshooting.

The operational parameters 40 and diagnostic information 42 discussed above are by way of example only. Those skilled in the art will appreciate that the controller for a vehicle turret may store additional or alternative operational parameters and/or diagnostic information. Further, those skilled in the art will recognize that the controller for a vehicle turret may include additional or alternative hardware components.

The controller 18 may transmit a snapshot of the current state of the controller to the computing device 22. The snapshot of the controller state may include, for example, the operational parameter settings and diagnostic information at the controller 18. This snapshot may be stored at the computing device 22 as a controller profile. Operators may modify the parameters in the controller profile and save new controller profiles for the modified parameter values. Operators may then transmit controller profiles to various controllers, and the controllers may update the values for the operational parameters at the controller based on the values for the parameters in the controller profile. In this way, operators may advantageously determine a desired set of parameters at one turret control system, store a controller profile with the desired parameter values, and update multiple control systems using the controller profile.

Moreover, operators may transmit the snapshot of the controller state to a remote location for further analysis. Technicians at the remote location may be able to identify problems based on the information contained in the snapshot and recommend adjustments to the parameters in order to address any operational issues. For example, if a turret operator experiences malfunctions in the field, the turret operator may remotely transmit the parameter settings and diagnostic information to a maintenance facility where technicians can analyze the information in the snapshot and transmit recommendations in response. In this way, the controller 18 and programming device 22 provide operators with the ability to remotely troubleshoot the turret control apparatus 11.

The computing device 22 may also store profiles for the controller 18 that include values for one or more of the operational parameters. For example, when the computing device 22 is firs connected to a controller 18, the computing device may load the initial parameter settings at the controller into an initial profile. An operator may then modify and adjust various parameters for testing, maintenance, or troubleshooting. The operator may use the computing device 22 to create an update profile that includes the updated parameters. In this way, an operator may change the operational parameters during testing and easily revert to the initial settings for the controller 18. Moreover, an operator may create an update profile at one controller 18, and then load the updated profile with the updated parameter settings on a different controller at a different turret drive system.

Turning now to FIG. 4, a flowchart 54 of example method steps for modifying an operational parameter and viewing diagnostic information at a controller is shown. First, a programming device is attached to the turret controller and each are powered on (step 56). The programming device may be attached to the turret controller while the controller is in a powered off or a powered on state. When the turret controller is first powered on, the controller may perform a diagnostic check (step 58) to compile diagnostic information relating to the controller as discussed above. The controller loads the operational parameters and diagnostic information into volatile memory (step 60). The controller may be able to determine that the programming device has been attached and is capable of receiving information. Accordingly, the controller may automatically transmit the turret operational parameters and diagnostic information in the volatile memory to the programming device (step 62), and the programming device may present the parameters and diagnostics to an operator at a display (step 64). As discussed above, the controller may periodically run diagnostic checks while the controller is powered on and store the new diagnostic information in the volatile memory at the controller (step 66). The controller may also automatically transmit the periodically updated diagnostic information to the programming device for display (step 68).

If an operator wants to modify an operational parameter, the operator may select an operational parameter to modify at the programming device (step 70). The operator inputs the new value for the selected parameter at the programming device (step 72), and the programming device transmits an update command for the selected parameter to the controller (step 74). The firmware at the controller, in this example, receives the update request and updates the value for the selected parameter in the volatile memory of the controller (step 76). In this example, as mentioned above, the modified value for the selected parameter is not committed to the non-volatile memory of the controller until the operator commits the updated value. If the operator commits the updated value for the selected parameter (step 78), the programming device transmits a commit command to the controller (80). The firmware at the controller, in this example, receives the commit command and updates the value for the selected parameter in non-volatile memory of the controller (step 82). Accordingly, once the updated value has been committed to non-volatile memory, the controller will retain the updated value during controlled turret rotation. The update and commit commands may be transmitted from the programming device to the controller as digital control signals.

As can be seen from the description above, the apparatus for controlling rotation of a turret of a vehicle allows a user to customize the apparatus according to the preferences of the user. As a result, when the controller is employed in military operations, controlled turret rotation may be adapted to the particular circumstances of an operation or mission. Furthermore, because the apparatus is adapted to transmit diagnostic metrics relating to controlled turret rotation, service personnel may readily troubleshoot and maintain the turret controller and accompanying turret drive system. By providing access to the diagnostic information stored at the controller, the time and complexity needed to diagnose and repair controlled turret drive systems is reduced.

In addition, the apparatus may be employed to input control signals at the controller 18 for the turret drive system 33. For example, the apparatus may be employed to indicate a desired speed, a desired direction, a maximum allowable speed, and the like. The apparatus may also be employed to, for example, inhibit drive in a particular direction or serve as an external fault monitoring display.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that a certain of the details described herein can be varied considerably without departing from the basic principles of the invention.

What is claimed is:

1. A customizable apparatus for controlling rotational movement of a turret of a vehicle comprising:

a memory that stores information relating to operation of the turret;

a communication port that exchanges communications relating to operation of the turret with a hand-held programming device, the hand-held programming device displays the information relating to operation of the turret, and in response to receipt of instructional user input at the hand-held programming device, the hand-held programming device transmits communications relating to the instructional user input to the communication port; and a controller that processes a communication received at the communication port from the hand-held programming device, the controller selectively provides access to the stored information relating to operation of the turret to the hand-held programming device, wherein the controller is configured to modify the information stored in memory relating to operation of the turret in response to the communication received from the hand-held programming device such that operation of the turret is selectively customized according to user preference.

2. The apparatus of claim 1 wherein:

the information relating to operation of the turret further comprises a parameter relating to an aspect of controlled turret rotation;

the communication received at the communication port further comprises an instruction to update the parameter with a value identified in the instruction; and in response to receipt of the instruction, the controller updates the parameter with the value identified in the instruction.

3. The apparatus of claim 2 wherein the controller modifies at least one parameter relating to an aspect of controlled turret rotation in accordance with user selection at the hand-held programming device such that operation of the turret is selectively customized to user preference.

4. The apparatus of claim 3 wherein the parameter relating to an aspect of controlled turret rotation corresponds to a rotational speed of the turret.

5. The apparatus of claim 3 wherein the parameter relating to an aspect of controlled turret rotation corresponds to a rotational acceleration or a rotational deceleration of the turret.

6. The apparatus of claim 3 wherein the parameter relating to an aspect of controlled turret rotation corresponds to a dampening ratio for the turret.

7. The apparatus of claim 3 wherein the parameter relating to an aspect of controlled turret rotation corresponds to a motor current limit or motor compensation for a motor coupled to the controller, and wherein the motor drives rotation of the turret.

8. The apparatus of claim 3 wherein the parameter relating to an aspect of controlled turret rotation corresponds to a throttle setting of a motor coupled to the controller, and wherein the motor drives rotation of the turret.

9. The apparatus of claim 3 wherein the parameter relating to an aspect of controlled turret rotation corresponds to a push speed limit when the controlled turret rotation is in a manual override mode.

10. The apparatus of claim 2 wherein:

the memory comprises a volatile memory and a non-volatile memory;

the controller stores the value identified in the instruction in the volatile memory in response to receipt of the instruction; and the controller stores the value identified in the instruction in the non-volatile memory in response to receipt of a subsequent communication at the communication port comprising an instruction to commit the value.

11. A method for customizing controlled rotational movement of a turret of a vehicle comprising:

storing information relating to operation of the turret in a memory;

exchanging communications relating to operation of the turret between a controller and a hand-held programming device;

displaying at the hand-held programming device the information relating to operation of the turret;

receiving instructional user input at the hand-held programming device;

transmitting from the hand-held programming device to the controller communications relating to the instructional user input;

processing a communication received from the hand-held programming device to selectively provide access to the stored information relating to operation of the turret to the hand-held programmable device; and modifying the information stored in memory relating to operation of the turret in response to the communication received from the hand-held programming device such that operation of the turret is selectively customized according to user preference.

12. The method of claim 11 wherein the information relating to operation of the turret further comprises a parameter relating to an aspect of controlled turret rotation and wherein the communication received from the hand-held programming device comprises an instruction to update the parameter with a value identified in the instruction, and further comprising updating the parameter with the value identified in the instruction.

13. The method of claim 12 further comprising modifying at least one parameter relating to controlled turret rotation to selectively customize operation of the turret according to user preference.

14. The method of claim 13 wherein the parameter relating to an aspect of controlled turret rotation is a rotational speed of the turret.

15. The method of claim 13 wherein the parameter relating to an aspect of controlled turret rotation is a rotational acceleration of the turret.

16. The method of claim 13 wherein the parameter relating to an aspect of controlled turret rotation is a rotational deceleration of the turret.

17. The method of claim 13 wherein the parameter relating to an aspect of controlled turret rotation is a motor current limit of a motor coupled to the controller, and wherein the motor drives rotation of the turret.

18. The method of claim 13 wherein the parameter relating to an aspect of controlled turret rotation is a throttle setting of a motor coupled to the controller, and wherein the motor drives rotation of the turret.

19. The apparatus of claim 1 wherein the controller is adapted to transmit the information to the hand-held programming device for troubleshooting and maintenance of controlled turret rotation.

20. The method of claim 13 wherein the parameter relating to an aspect of controlled turret rotation is a push speed when the controlled turret rotation is in a manual override mode.

21. The apparatus of claim 1 wherein the hand-held programming device automatically displays the information relating to operation of the turret in response to coupling of the hand-held programming device to the communication port.

22. The apparatus of claim 1 further comprising a cable to couple the hand-held programming device to the communication port.

23. The apparatus of claim 1 wherein:

the information relating to operation of the turret further comprises at least one parameter and at least one diagnostic metric respectively relating to an aspect of controlled turret rotation; and the controller transmits a snapshot of a current state of the controller to the external computing device where the snapshot includes the information relating to operation of the turret.

24. The apparatus of claim 1 wherein:

the information relating to operation of the turret further comprises at least one parameter relating to an aspect of controlled turret rotation;

the communication received at the communication port further comprises a profile of a state of the controller, the profile includes information corresponding to the at least one parameter; and the controller updates the at least one parameter based on the corresponding information included in the profile.

25. The method of claim 11 further comprising automatically displaying the information relating to operation of the turret in response to coupling the hand-held programming device to the controller.

26. The method of claim 11 further comprising using a cable to releasably couple the hand-held programming device to a communication port associated with the controller.

27. The method of claim 11 wherein the information relating to operation of the turret further comprises at least one parameter and at least one diagnostic metric respectively relating to an aspect of controlled turret rotation and further comprising:

transmitting a snapshot that includes the information relating to operation of the turret to the hand-held programming device.

28. The method of claim 11 wherein the information relating to operation of the turret further comprises at least one parameter relating to an aspect of controlled turret rotation further comprising:

receiving a communication at the communication port, the communication comprises a profile that includes information corresponding to the at least one parameter; and updating the at least one parameter based on the corresponding information included in the profile.

29. The method of claim 11 further comprising:

transmitting the information relating to operation of the turret to the hand-held programming device for troubleshooting and maintenance of controlled turret rotation.

30. The method of claim 12 wherein the memory comprises a volatile memory and a non-volatile memory and further comprising:

storing the value identified in the instruction in the volatile memory in response to receipt of the instruction; and storing the value identified in the instruction in the non-volatile memory in response to initiation of a shutdown process for the controller.

* * * * *